United States Patent [19]

Arens

[11] Patent Number: 4,523,903

[45] Date of Patent: Jun. 18, 1985

[54] DOSING PUMP

[75] Inventor: Hans Arens, Wertingen, Fed. Rep. of Germany

[73] Assignee: Grunbeck Wasseraufbereitung GmbH, Hochstadt, Fed. Rep. of Germany

[21] Appl. No.: 557,150

[22] PCT Filed: Mar. 22, 1983

[86] PCT No.: PCT/EP83/00084

§ 371 Date: Nov. 9, 1983

§ 102(e) Date: Nov. 9, 1983

[87] PCT Pub. No.: WO83/03447

PCT Pub. Date: Oct. 13, 1983

[30] Foreign Application Priority Data

Mar. 24, 1982 [DE] Fed. Rep. of Germany ..... 3210821

[51] Int. Cl.[3] ..... F04B 7/04; F04B 23/04

[52] U.S. Cl. ..... 417/489; 417/502; 417/503; 417/521; 222/318

[58] Field of Search ..... 417/439, 489, 503, 521, 417/502, 395; 92/83, 86.5; 222/105, 318; 604/123

[56] References Cited

U.S. PATENT DOCUMENTS

| | | | |
|---|---|---|---|
| 862,867 | 8/1907 | Eggleston | 417/390 |
| 3,680,985 | 8/1972 | Ginsberg et al. | 417/502 |
| 3,765,802 | 10/1973 | Leitermann et al. | 417/503 X |
| 3,945,772 | 3/1976 | Van de Moortele | 417/503 X |
| 4,029,442 | 6/1977 | Schlosser | 417/489 |
| 4,035,109 | 7/1977 | Drath et al. | 417/489 X |
| 4,139,122 | 2/1979 | Bauer | 417/489 X |
| 4,236,877 | 12/1980 | Curtis | 417/251 X |
| 4,263,602 | 4/1981 | Matsumoto et al. | 417/503 X |
| 4,336,000 | 6/1982 | Jorgensen et al. | 417/503 X |
| 4,336,800 | 6/1982 | Giovanni | 604/123 |
| 4,375,864 | 3/1983 | Savage | 222/105 X |

FOREIGN PATENT DOCUMENTS

| | | | |
|---|---|---|---|
| 304021 | 9/1915 | Fed. Rep. of Germany | 417/503 |
| 2651614 | 5/1978 | Fed. Rep. of Germany | 417/521 |
| 2120945 | 8/1972 | France | 417/489 |

*Primary Examiner*—William L. Freeh
*Assistant Examiner*—Paul F. Neils
*Attorney, Agent, or Firm*—Donald Brown; Robert T. Gammons

[57] ABSTRACT

A dosing pump (1) is created allowing to accurately dose a medium to be dosed as a function of time or of a flow rate. The dosing pump (1) utilizes a predelivery obtained by a diaphragm (11) as well as a piston-cylinder-pump for dosing. The pump cylinder is connected with the suction conduit so as to prevent any pressure drop when the piston emerges from the cylinder. A crystallization or polymerization of the dosing agent in the piston-cylinder-means is thereby prevented.

6 Claims, 1 Drawing Figure

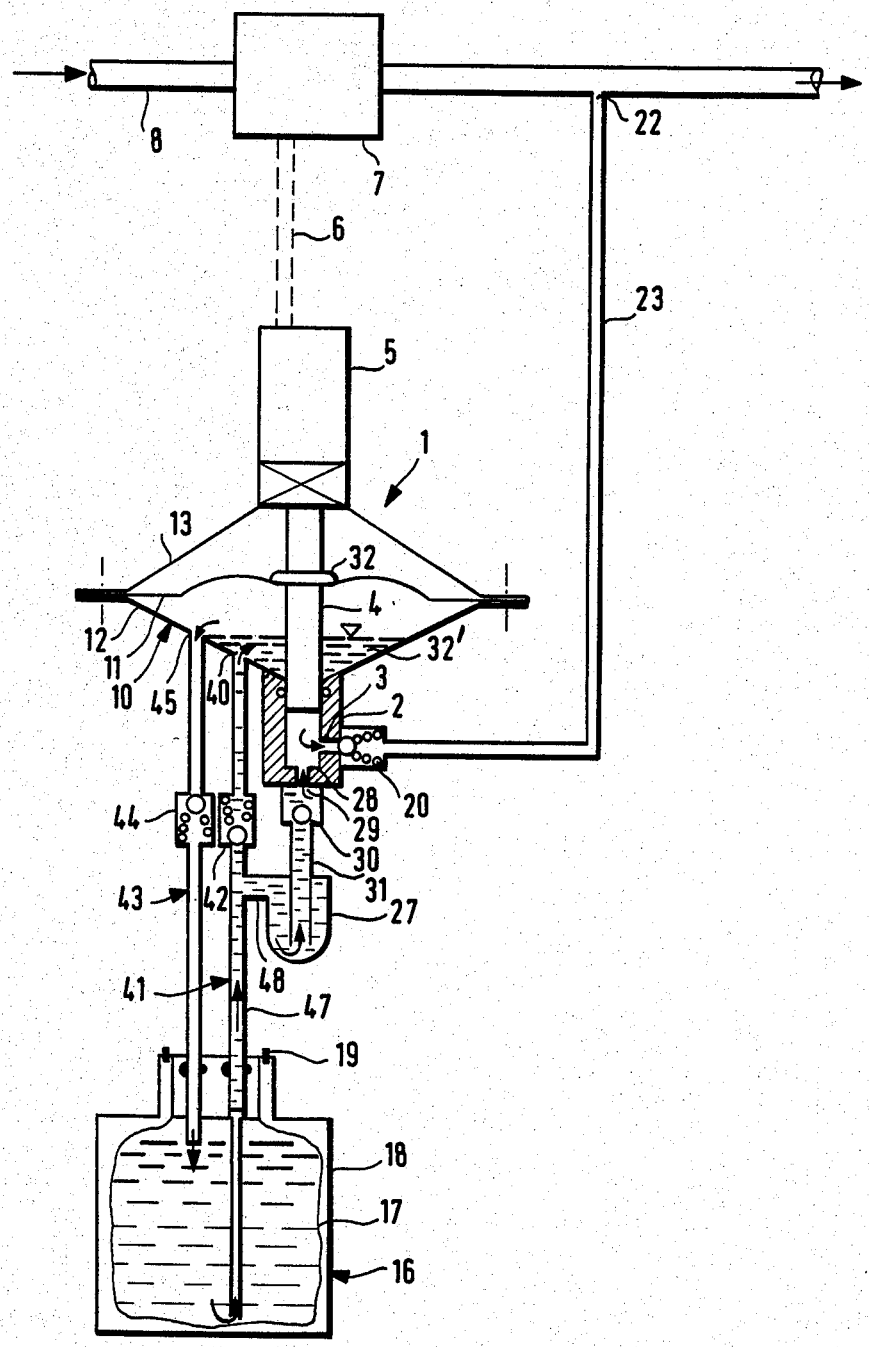
8
7
22
6
23
5
1
13
32
4
12
11
10
45
40
32'
3
2
20
28
29
30
31
27
44
43
42
41
48
47
19
18
17
16

DOSING PUMP

The invention refers to a dosing pump comprising a pump cylinder connected at its inlet side with a predelivery chamber and at its outlet side with a dosing point and a dosing piston cooperating therewith as well as a diaphragm, whereby the predelivery chamber is positioned above the pump cylinder and is connectable with a container for dosing agent via a suction conduit comprising a suction valve and a return conduit comprising a pressure valve.

In a known dosing pump with dosing piston-cylinder-means and predelivery diaphragm the predelivery chamber is connected with a container for dosing agent via a suction conduit comprising a suction valve and a return conduit comprising a pressure valve. The predelivery is performed via the suction conduit and the suction valve to the predelivery chamber. The dosing piston takes the required amount of dosing agent from the predelivery chamber. The excess amount of dosing agent is transported back into the container for dosing agent via the pressure valve and the return conduit. In a known dosing pump the pump cylinder is connectable with a dosing point via a pressure valve. When the piston is withdrawn from the cylinder a vacuum is drawn which causes volatilization of the dosing agent. In using certain dosing agents such as silicates, hydrates of soda or the like this leads to a crystallizing-out within the pump cylinder and thus to a destruction of the dosing pump. In using other dosing agents such an evacuation leads to a polymerisation and thus also to a destruction of the piston-cylinder-means.

It is the object of the invention to create a dosing pump of the kind described at the outset where the above discussed drawbacks are avoided. In particular the expansion within the pump cylinder during the emersion of the piston shall be avoided.

This object is achieved with a dosing pump according to the generic part by a connection of the pump cylinder with the suction conduit.

Preferably the pump cylinder is connected with the suction conduit by means of a conduit comprising a sump.

It is in particular the advantage gained by the invention that by avoiding the evacuation the above-mentioned drawbacks are avoided and thus the piston-cylinder-means will have a substantially longer lifetime and hence the dosing pump in general will be less susceptible to maintenance.

An embodiment of the invention is shown in the drawing and in the following described in greater detail.

The FIGURE shows a schematic and partly sectional representation of a dosing pump connected with a water supply and having a container for dosing agent.

The dosing pump 1 comprises a pump cylinder 2 having an inlet positioned above as seen in vertical direction and an outlet 3 positioned close to its lower end. Above the pump cylinder 2 there is provided a dosing piston 4 being reciprocated relative to the pump cylinder by means of a schematically represented piston drive means 5 and thus is inserted into the cylinder and withdrawn from the cylinder, resp. The piston drive means 5 is connected with a pulse generator 7 by means of a control line 6, the pulse generator providing control pulses to the piston drive means as a function of the fluid amount flowing through a conduit 8.

At its upper side the pump cylinder 2 is connected with a predelivery chamber 9 constituted by a housing 10. The walls of the housing 10 may be formed as diaphragm clamps 12, 13 laterally gripping a diaphragm 11. The lower part of the housing 10 is hermetically connected with the wall of the pump cylinder. In a distance from the wall of the pump cylinder there is provided an inlet 40 connected with a tube-shaped suction conduit 41, which is connectable with a container 16 for dosing agent. The suction conduit comprises a suction valve 42 preventing backflow from the predelivery chamber 9 into the container 16. The inlet 40 is disposed on a level, as seen from the fluid level formed in the predelivery chamber, vertically above the inlet side of the pump cylinder 2.

There is further provided a return conduit 43 being as well connectable with the container 16 and comprising a pressure valve 44. The return conduit 43 is connected with the predelivery chamber 9 at an outlet 45, whereby the outlet 45 is disposed, as seen in vertical direction and relative to the new fluid level formed in the predelivery chamber, above the inlet side of the pump cylinder 2 and preferably above the inlet 40.

Preferably the container 16 for dosing agent comprises a flexible bag 17 containing the dosing agent and being supported by a supporting container 18. The supporting container comprises venting holes 19. The conduits 41 and 43 are tightly connected with the interior of the flexible bag 17. In this manner there is formed a bacteria-tight connection between the conduits 41, 43 and the container for dosing agent, since no venting of the dosing agent is required. In particular for not fumigating dosing agents also a conventional container for dosing agent may be used, which is entered by air corresponding to the amount of dosing agent removed by suction. A bacteria filter may be provided in the venting hole in order to allow disinfected air to enter the container.

Directly at the outlet 3 there is provided a pressure valve 20 being formed as a spring-biased ball valve in the embodiment shown. The pressure valve is connected with a connecting conduit 23 leading to a dosing point 22. The pressure valve 20 is provided as close as possible at the pump cylinder and preferably directly at the outlet thereof.

An approximately horizontally formed conduit section 48 ending in the upper portion of a sump 27 branches off from the section 47 of the suction conduit 41 connecting the container 16 for dosing agent with the suction valve 42 before the suction valve 42.

At its bottom 28 positioned below in vertical direction the pump cylinder 2 comprises an opening 29 leading into the interior of the sump 27 via a suction valve 30 directly adjacent to the opening 29 and a suction conduit 31. The suction conduit extends nearly down to the bottom of the sump.

As shown in the FIGURE the diaphragm 11 is connected with the dosing piston, for example by means of a fastening washer 32 such that the diaphragm is displaced by the upward and downward movement, resp., of the dosing piston. At the displacement of the diaphragm 11 upwardly from the lower dead centre in the first stroke the air within the suction system is sucked off and thereby the dosing agent is delivered from the flexible bag 17 into the predelivery chamber 9. With the lifting of the diaphragm 11 the dosing piston 4 is emerged from the pump cylinder 2 such that a part of the delivered dosing agent completely covers the pump cylinder 2 and an excess 32′ of dosing agent remains within the predelivery chamber 9. The dosing is performed at the downward movement of pump piston 4 and diaphragm 11 and the major part of the dosing agent still present within the predelivery chamber is delivered back into the container 16 for dosing agent through the return conduit 43. A portion 32′ of the predelivered amount of dosing agent remains above the dosing piston 4, because the outlet 45 is in vertical direction on a higher level than the upper inlet of the pump cylinder 2. The difference of level between the outlet 45 and the inlet of the pump cylinder is selected such that a desired portion of the pump cylinder surface always remains within the delivered dosing amount in order to avoid the formation of an incrustation at the dosing piston 4.

During the suction of dosing fluid the sump 27 is permanently filled with dosing agent. At the upward movement of the dosing piston 4 the dosing agent is sucked from the sump 27 through the suction conduit 31 and the suction valve 30 into the pump cylinder 2 such that in this chamber an evacuation leading to a crystallization or polymerisation is avoided. The size of the sump is selected such that at the suction there always remains sufficient fluid and air pulsating in the conduit 41 during the operation is prevented from entering into the suction valve 30 of the dosing pump 1.

I claim:

1. A dosing pump comprising a pump cylinder having a first inlet, a second inlet and an outlet, a suction valve and a discharge valve being provided at the second inlet and the outlet, respectively, a dosing piston cooperating with the pump cylinder, a diaphragm connected with the dosing piston and being disposed within a diaphragm chamber disposed at a level above the pump cylinder, wherein the diaphragm chamber is connected with a container for dosing agent via a suction conduit comprising a suction valve and a return conduit comprising a pressure valve, and with the pump cylinder via a connection forming the first inlet of the pump cylinder, the dosing piston extending through this connection and allowing fluid to enter the pump cylinder from the diaphragm chamber when the dosing piston emerges from the pump cylinder, and wherein a suction line is provided which connects the second inlet with the suction conduit.

2. The dosing pump of claim 1, wherein the suction line connects the second inlet with that portion of the suction conduit which extends between the container for dosing agent and the suction valve.

3. The dosing pump of claim 1, wherein said suction line comprises a pump sump.

4. The dosing pump of claim 1, wherein said return conduit opens into said diaphragm chamber at a higher level than the suction conduit.

5. A dosing pump comprising a pump cylinder having a first inlet, a second inlet and an outlet, a suction valve and a discharge valve being provided at the second inlet and the outlet, respectively, a dosing piston cooperating with the pump cylinder, a diaphragm connected with the dosing piston and being disposed within a diaphragm chamber disposed at a level above the pump cylinder, wherein the diaphragm chamber is connected with a container for dosing agent via a suction conduit comprising a suction valve and a return conduit comprising a pressure valve, and with the pump cylinder via a connection forming the first inlet of the pump cylinder, the dosing piston extending through this connection and allowing fluid to enter the pump cylinder from the diaphragm chamber when the dosing piston emerges from the pump cylinder, and wherein the second inlet is connected with a suction pipe and the suction conduit is connected with a pump sump, said suction pipe extending into said pump sump.

6. The dosing pump of claim 5, wherein said return conduit opens into said diaphragm chamber at a higher level than the suction conduit.

* * * * *